US005081493A

United States Patent [19]

Miyasaka

[11] Patent Number: 5,081,493

[45] Date of Patent: Jan. 14, 1992

[54] METHOD OF CONTROLLING THERMAL FIXING UNIT FOR ELECTRONIC TRANSFER PRINTER

[75] Inventor: Toshiaki Miyasaka, Tokyo, Japan

[73] Assignee: Mutoh Industries Ltd., Tokyo, Japan

[21] Appl. No.: 498,746

[22] Filed: Mar. 26, 1990

[30] Foreign Application Priority Data

Apr. 26, 1989 [JP] Japan ..... 1-106894

[51] Int. Cl.[5] ..... G03G 15/20; G03G 21/00; G03G 13/20

[52] U.S. Cl. ..... 355/208; 219/216; 355/285

[58] Field of Search ..... 355/202, 208, 282, 285; 219/216

[56] References Cited

U.S. PATENT DOCUMENTS 4,425,494 1/1984 Enomoto et al. ..... 355/208 X
4,480,908 11/1984 Anzai et la. ..... 355/285
4,618,247 10/1986 Tsuji ..... 355/208
4,878,092 10/1989 Arai ..... 355/208

*Primary Examiner*—Fred L. Braun
*Attorney, Agent, or Firm*—Wenderoth, Lind & Ponack

[57] ABSTRACT

A controller receives data transferred thereto from a host computer to control a photosensitive drum, a writing head, and a thermal setting device. Futher, the controller detects whether or not the data from the host computer is being transferred. When there is no transference of data, the temperature of a heater of the thermal setting device is set to a pre-heating temperature. When data is being transferred to the controller, the heater temperature of the thermal setting device is set to a setting temperature which is higher than the pre-heating temperature.

1 Claim, 3 Drawing Sheets

METHOD OF CONTROLLING THERMAL FIXING UNIT FOR ELECTRONIC TRANSFER PRINTER

BRIEF SUMMARY OF THE INVENTION

This invention relates to an electronic transfer printer in which an electrostatic latent image is formed on a photosensitive screen of a photosensitive drum that is uniformly charged by irradiating light carrying necessary information on the photosensitive screen, and this latent image is developed and is visualized as a toner image on the photosensitive screen, and the resulting toner image is transferred to a plain paper, and is fixed on the paper by a thermal transfer unit, and more particularly to a method of controlling the temperature of the thermal fixing unit.

In the conventional electronic transfer printer, when a power source switch was turned on, the heater temperature of the thermal fixing unit was kept at a fixing temperature even when the data was not transferred to a controller proper of the electronic transfer printer.

When the transfer of the data on the controller did not take place, and the heater temperature of the thermal fixing unit was set to a preheating temperature, and the heater temperature of the thermal fixing unit was set to a fixing temperature only when the transfer of the data had taken place, the consumption of electrical power could be reduced, and the durability of the thermal fixing unit could be improved. The preheating temperature mentioned herein was a temperature which was lower than the fixing temperature, for example, from 80° C. to 100° C., which could be elevated to the fixing temperature in a fixed time.

In order to achieve the foregoing object, this invention is arranged in such a way that the presence or absence of the transfer of the data to the controller is detected, and when no data is detected, the heater temperature of the thermal mixing unit is set to a preheating temperature, and in case there is the data to be transferred, the heater temperature is set to the fixing temperature.

DESCRIPTION OF THE PREFERRED EMBODIMENT

An embodiment of this invention will be described in the following by referring to the attached drawings.

Figure 3:
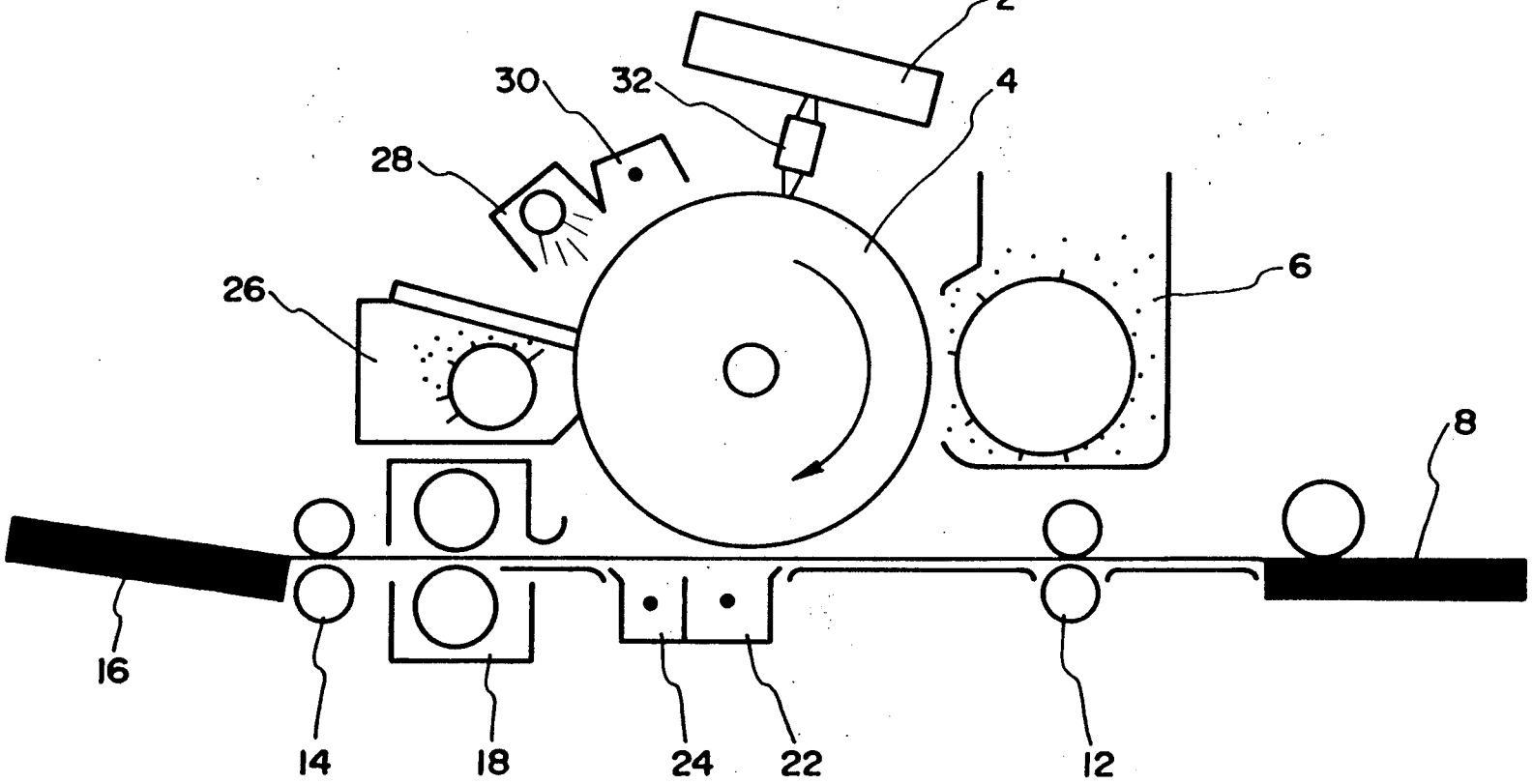
FIG. 3 is an explanatory drawing showing an embodiment of this invention.
Figure 4:
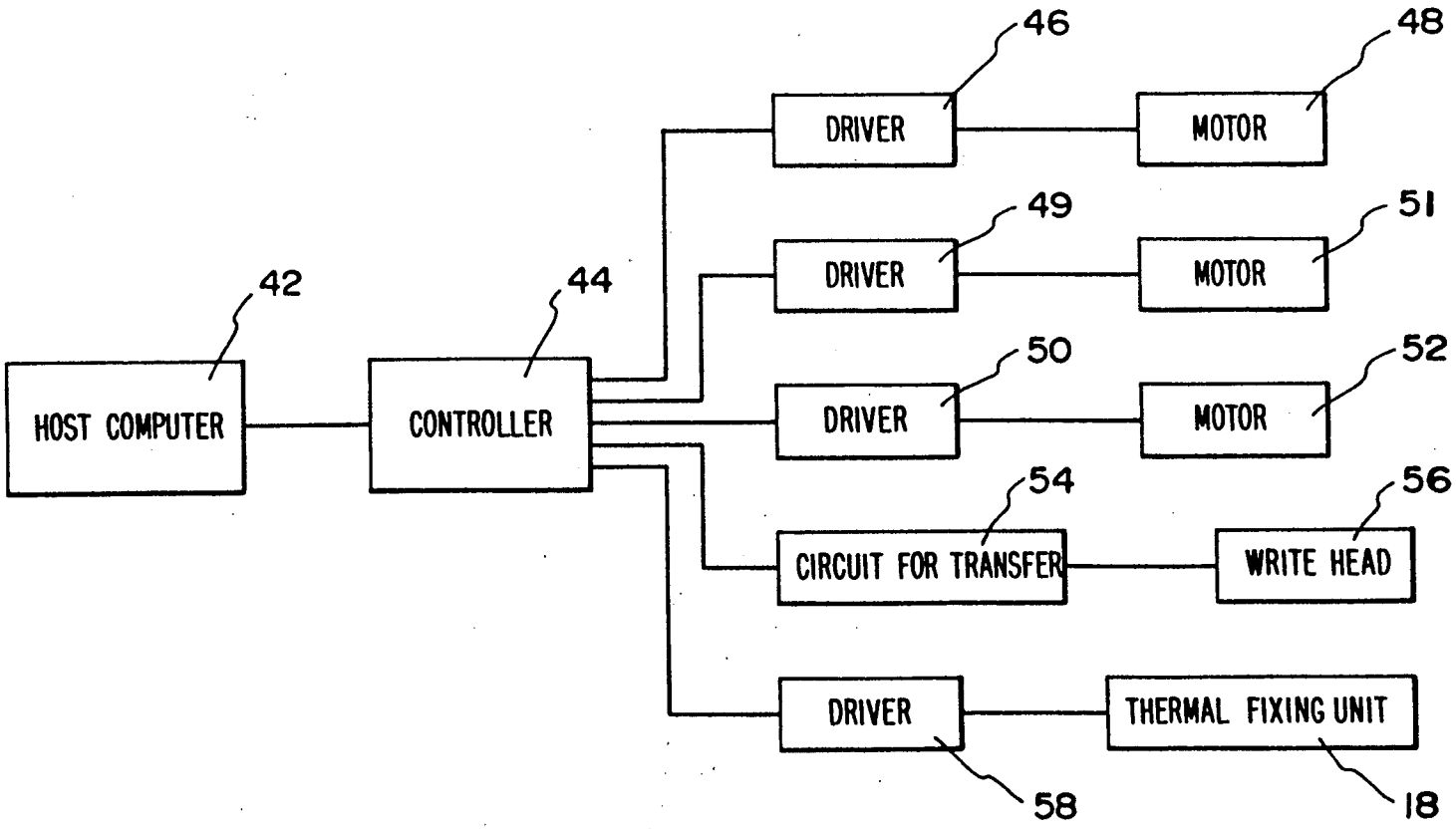
FIG. 4 is a block explanatory drawing showing this invention.

In FIGS. 3 and 4, reference numeral 2 denotes a light emitting diode array, and constitutes a write head 56 together with a condensing lens 32, and irradiates necessary light on a photosensitive drum 4. The photosensitive drum 4 is constructed in such a way that a controller 44 is connected to a motor 48 by means of a driver 46, and its rotation is controlled in a fixed direction by the controller 44. Reference numeral 6 denotes a developing unit, and an electrostatic latent image formed on a photosensitive screen of the photosensitive drum 4 is made to be visualized as a toner image. Reference numeral 8 denotes a paper cassette, and the paper coming out from the paper cassette 8 is sent to a transfer unit 22 by means of a feed roller 12 that is driven by a motor 52, and the toner image on the photosensitive drum 4 is transferred to the paper. Reference numeral 24 denotes a peel-apart unit, and its role is to peel-apart the paper from the photosensitive drum 4. Reference numeral 18 denotes a thermal fixing unit for fixing the toner image on the paper, and is connected to the controller 44 by means of the driver 58, and its temperature is controlled to be either a preheating temperature or a fixing temperature (for example, 150° C.) by the controller 44. Reference number 14 denotes a feed roller that is driven by the motor 52, and is disposed to feed the paper coming out of the thermal fixing unit 18 to a stacker 16. Reference numeral 26 denotes a cleaner, and its role is to scrape away the toner remaining on the photosensitive screen of the photosensitive drum 4 after the transfer, and is provided with a blade. Reference numeral 28 denotes an eliminating lamp.

Figure 1:
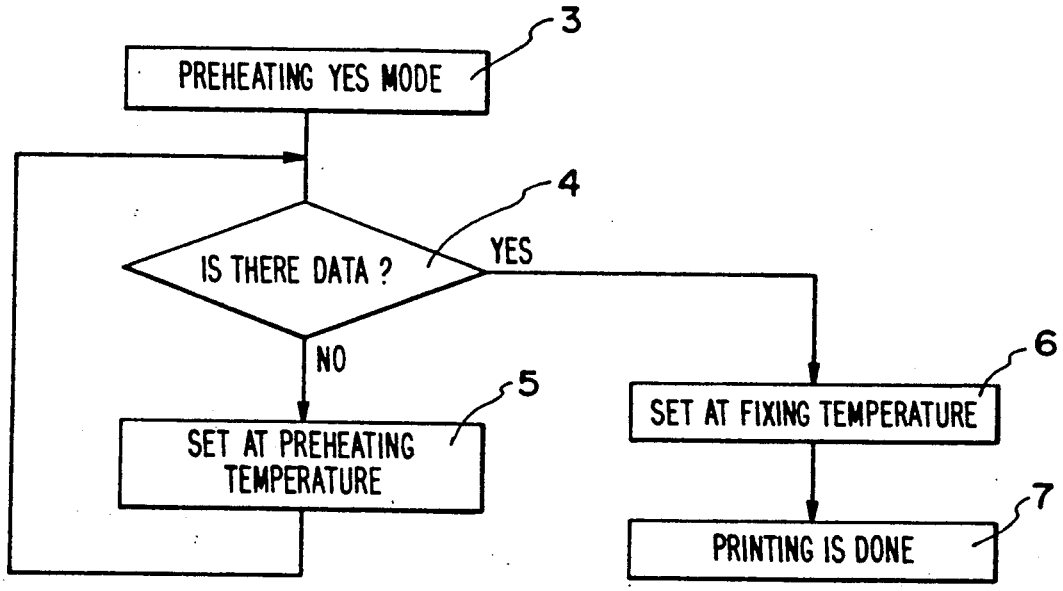
FIG. 1 is a flowchart showing an operation of this invention.
Figure 2:
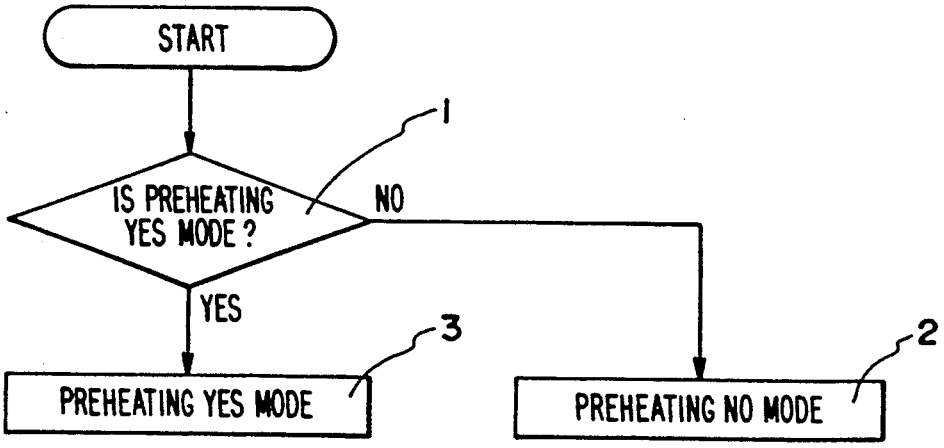
FIG. 2 is a flowchart showing an operation of this invention.

In the foregoing construction, as shown in FIG. 2, when the printer is operated, the controller determines (step 1) the presence or absence of a preheating mode. When the determination shows NO in the first step, the controller 44 shifts to a preheating no mode (step 2), and when the determination shows YES, the controller 44 shifts to a preheating yes mode (step 3). As shown in FIG. 1, in the step 4, when the determination shows that there is no transfer of the data from a host computer 42 to a data memory unit of the controller 44, the heater temperature of the thermal fixing unit 18 is kept at the preheating temperature (step 5). In this embodiment, the preheating temperature is set at a temperature between 80° C.~100° C. when the data is transferred to the controller 44, and the data is detected in the step 4, the controller 44 starts to raise the heater temperature of the thermal fixing unit 18, in the first place, from the preheating temperature, and keeps the temperature when it reaches the fixing temperature (step 6). On the other hand, the data inputted to the controller 44 is supplied to a write head 56 through a circuit 54 for later transfer, the bit map development is made, and an electrostatic latent image of the data is produced on the photosensitive screen of the photosensitive drum 4 that is uniformly charged by a charger 30 by means of the write head 56. This electrostatic latent image is visualized as a toner image on the photosensitive screen after passing through the developing unit 6, and the toner image is transferred to a plain paper sent from the paper cassette 8 by means of a transfer unit 22. Thereafter, the paper is peeled apart from the photosensitive screen of the photosensitive drum 4 by the peel-apart unit 24, and the toner is fixed by the thermal fixing unit 18 that is heated at the fixing temperature and is stored in a stacker 16 (step 7).

By the way, with respect to the setting method of the preheating mode that becomes a subject of the determination of the controller 44, a preheating mode setting method by providing a preheating mode switch on a panel switch of the controller 44, or a preheating mode setting method by software at the host computer side or a preheating mode setting method using both the software and the hardware may be employed.

This invention has an effect of reducing the consumption electrical power by lowering the heater temperature of the thermal fixing unit while no data transfer is made as described in the foregoing. Also, the durability of the thermal fixing unit is improved with respect to time by keeping the heater unit of the thermal fixing unit at a high temperature (fixing temperature) for only a short time, and moreover, since there is no need for a fan or a bigger space for heat countermeasures inside of the electronic transfer printer proper, the entire electronic transfer printer can be formed in a compact size. Furthermore, there is an effect of minimizing troubles of the electronic transfer printer due to the lower internal temperature.

What is claimed is:

1. A method of controlling the temperature of a thermal fixing unit for an electronic transfer printer in which data transferred to a controller is supplied to a write head disposed in opposition to a photosensitive screen of a photosensitive drum that is uniformly charged, the light carrying the necessary information is irradiated on the photosensitive screen of the photosensitive drum by the write head whereby an electrostatic latent image is formed on the photosensitive screen, and this latent image is visualized as a toner image on the photosensitive screen by developing this latent image, and thereafter, this toner image is transferred to a plain paper, and is fixed on the plain paper by a thermal fixing unit, the improved method comprising: detecting the presence or absence of data being transferred to the controller; setting the heater temperature of the thermal fixing unit to a preheating temperature in the absence of data being transferred, and setting the heater temperature of the thermal fixing unit to a fixing temperature in the presence of data being transferred.

* * * * *